US007824317B2

(12) United States Patent
Nakamura

(10) Patent No.: US 7,824,317 B2
(45) Date of Patent: Nov. 2, 2010

(54) MACHINE FOR TRAINING VARIOUS KINDS OF ABDOMINAL AND LUMBAR MUSCLES

(75) Inventor: Hiroshi Nakamura, Tokyo (JP)

(73) Assignee: Jupitah Yugenkaisha, Tokyo (JP)

( * ) Notice: Subject to any disclaimer, the term of this patent is extended or adjusted under 35 U.S.C. 154(b) by 0 days.

(21) Appl. No.: 11/579,801

(22) PCT Filed: May 25, 2005

(86) PCT No.: PCT/JP2005/009511

§ 371 (c)(1),
(2), (4) Date: Nov. 7, 2006

(87) PCT Pub. No.: WO2005/118078

PCT Pub. Date: Dec. 15, 2005

(65) Prior Publication Data

US 2007/0243982 A1 Oct. 18, 2007

(30) Foreign Application Priority Data

Jun. 2, 2004 (JP) ..... 2004-164840

(51) Int. Cl.
*A63B 21/00* (2006.01)

(52) U.S. Cl. ..... 482/134; 482/111; 482/123

(58) Field of Classification Search ..... 482/129–137, 482/140, 78, 80, 115, 120, 121, 122, 123, 482/124, 125, 138, 139, 141, 146, 147, 148, 482/905, 907, 910; 601/33
See application file for complete search history.

(56) References Cited

U.S. PATENT DOCUMENTS 911,925 A * 2/1909 Del Valle Y Zeno ..... 73/379.08
3,633,907 A * 1/1972 Cane et al. ..... 482/123
4,089,520 A * 5/1978 Ozbey et al. ..... 482/130
4,108,429 A * 8/1978 Minichiello ..... 482/130
4,170,351 A * 10/1979 Ozbey et al. ..... 482/130

(Continued)

FOREIGN PATENT DOCUMENTS

JP 52-79159 6/1977

(Continued)

*Primary Examiner*—Loan Thanh
*Assistant Examiner*—Daniel F. Roland
(74) *Attorney, Agent, or Firm*—Jacobson Holman PLLC

(57) ABSTRACT

A user repeats a right and left swaying motion while holding a movable body in which a resistance force is generated by tension of an elastic member, hydraulic pressure, pneumatic pressure, or the like, between his/her two legs, thereby efficiently strengthening, particularly, abdominal muscles, such as rectus muscles of an abdomen, external abdominal oblique muscles, and transverse abdominal muscles, erector muscles of a spine, or iliopsoas muscles, and strengthening various kinds of abdominal and lumbar muscles with an easy motion without laying burden on a waist, unlike the motion of making a user's upper body stand or lie down, which is conventionally seen. A machine trains various kinds of abdominal and lumbar muscles, by a movable body being held between the user's two legs and is swingably journalled to a base plate. The base plate is pivotable with respect to a seating plate on which a user sits, and a resistance force is loaded to the movable body in a swinging direction, and an elastic member, such as rubber or a spring, or a member using hydraulic pressure, is interposed between the movable body and the base plate.

3 Claims, 9 Drawing Sheets

U.S. PATENT DOCUMENTS

| | | | | | |
|---|---|---|---|---|---|
| 4,632,393 | A * | 12/1986 | Van Noord | 482/133 |
| 5,037,085 | A * | 8/1991 | Wexler | 482/148 |
| 5,122,106 | A * | 6/1992 | Atwood et al. | 482/131 |
| 5,352,173 | A * | 10/1994 | McLaughlin | 482/123 |
| 5,520,615 | A * | 5/1996 | Fontana et al. | 601/33 |
| 5,551,934 | A * | 9/1996 | Binette | 482/123 |
| 5,669,862 | A * | 9/1997 | Sayman | 482/127 |
| 5,746,688 | A * | 5/1998 | Prager | 482/142 |
| 5,752,901 | A * | 5/1998 | Lee | 482/130 |
| 5,839,998 | A * | 11/1998 | Wilkinson | 482/140 |
| 5,921,901 | A * | 7/1999 | Palacios | 482/132 |
| 5,951,448 | A * | 9/1999 | Bolland | 482/112 |
| 5,957,820 | A * | 9/1999 | Zarillo et al. | 482/121 |
| 6,086,521 | A * | 7/2000 | Solland | 482/140 |
| 6,152,865 | A * | 11/2000 | Beauvoir | 482/140 |
| 6,402,667 | B1 * | 6/2002 | Dahn | 482/121 |
| 6,402,669 | B1 * | 6/2002 | Olstad | 482/123 |
| 6,500,099 | B1 * | 12/2002 | Eschenbach | 482/57 |
| 6,569,069 | B1 * | 5/2003 | Linares | 482/148 |
| 6,932,748 | B2 * | 8/2005 | Huang | 482/139 |
| 6,966,871 | B2 * | 11/2005 | Parmater | 482/140 |
| 7,137,934 | B2 * | 11/2006 | Paramater | 482/123 |
| 7,169,097 | B1 * | 1/2007 | Stearns | 482/142 |
| 7,172,539 | B1 * | 2/2007 | Bythewood et al. | 482/140 |
| 7,172,541 | B2 * | 2/2007 | Boland et al. | 482/140 |
| 7,270,629 | B1 * | 9/2007 | Kramer | 482/95 |
| 2002/0137607 | A1 * | 9/2002 | Endelman | 482/123 |
| 2003/0176263 | A1 * | 9/2003 | Parmater | 482/140 |
| 2003/0186793 | A1 * | 10/2003 | Chen | 482/140 |
| 2004/0067828 | A1 * | 4/2004 | Croft | 482/123 |
| 2004/0067831 | A1 * | 4/2004 | Hou | 482/140 |
| 2004/0082450 | A1 * | 4/2004 | Casey et al. | 482/140 |
| 2004/0185987 | A1 * | 9/2004 | Ruzansky | 482/8 |
| 2005/0101460 | A1 * | 5/2005 | Lobban | 482/140 |
| 2007/0281839 | A1 * | 12/2007 | Lin et al. | 482/140 |

FOREIGN PATENT DOCUMENTS

| | | |
|---|---|---|
| JP | 63-29560 | 2/1988 |
| JP | 3000544 | 1/1994 |
| WO | WO99/22821 | 5/1999 |

* cited by examiner

MACHINE FOR TRAINING VARIOUS KINDS OF ABDOMINAL AND LUMBAR MUSCLES

This is a nationalization of PCT/JP05/009511 filed May 25, 2005 and published in Japanese

TECHNICAL FIELD

The present invention relates to a abdominal and lumbar muscle training machine for strengthening various kinds of abdominal and lumbar muscles, and more specifically, to a machine for training various kinds of abdominal and lumbar muscles that can be widely used for the purpose of muscular strength buildup of athletes, shape-up by formation of a curve around a waist, health promotion of old people, rehabilitation exercise after an illness, lumbago treatment by strengthening muscles around a lumbar, and the like, readily at homes, offices, and the like.

BACKGROUND ART

Conventionally, various training machines for strengthening abdominal muscles are provided (for example, refer to Japanese Utility Model Registration No. 3000544).

DISCLOSURE OF THE INVENTION

Problem that the Invention is to Solve

The training machines that are conventionally provided as mentioned above are on the basis of abdominal exercise that a user repeats a motion of standing or laying down his/her upper body in a supine state.

However, such abdominal exercise is suitable for, mainly, muscle strengthening of a part above rectus muscles of an abdomen, but it is often unsuitable for strengthening external abdominal oblique muscles, internal abdominal oblique muscles, transverse abdominal muscles, and muscles around a lumbar.

Further, there is a case where the repeating exercise of standing or laying down a user's upper body in a supine state is difficult for old people or people who have an illness in a lumbar part and consequently proper muscle strengthening cannot be achieved.

When a person has gotten pot-bellied due to excessive caloric intake, as an instance, he/she will suffer from lumbago because the lumbar protrudes forward. In this case, if muscles around the lumbar principally involving an abdominal part can be strengthened by an exercise that does not impose an excessive burden on a person who suffers from lumbago, for example, an exercise that a person inclines his/her knees to the left or right while bending his/her knees in a supine posture, thereby naturally turning his/her lumbar, the pressure on nerves is reduced, and consequently the lumbago can be relieved.

Meanwhile, there is known a training machine that strengthens abdominal muscles by applying a load by weights in twisting on the basis of a motion that a person twists his/her lower body with his/her upper body fixed while he/she sit down on a chair, a motion that a person twists his/her upper body with his/her lower body fixed while he/she sits down on a chair, or the like. Since the training machine has a highly expensive and complicated structure to be installed in a sports gymnasium, it cannot be routinely used at homes or the like. Also, a patient who is difficult to sit on a chair cannot use such a machine. Moreover, there is also a possibility that an old person may fall down while he/she sits on a chair and may be damaged.

It is important to continue abdominal muscle training similarly to other muscle strengthening. Therefore, it is desirable that the abdominal muscle training is performed using a machine having portability, which can be easily installed in a routine environment, that is, at homes or offices.

Further, it is important that a person can perform the training easily without cheering up himself/herself in order to make him/her continue the training, and it is desirable that a person can perform the training in a comfortable posture in which the person is rested in a supine state with his/her knees bent.

Means for Solving the Problem

The invention has been conceived to solve the above problems. Therefore, the invention provides a machine for training various kinds of abdominal and lumbar muscles, in which a movable body to be held between two legs of a user is swingably journalled to a base plate, a self-weight pressing plate on which the user lies supine or sits is provided at a side part of the base plate, and means that loads a resistance force to the movable body in a swinging direction is interposed between the movable body and the base plate.

Further, the invention provides a machine for training various kinds of abdominal and lumbar muscles, in which a movable body to be held between two legs of a user is swingably journalled to a base plate, the base plate is adapted to be pivotable with respect to a self-weight pressing plate on which the user lies supine or sits, and means that loads a resistance force to the movable body in a swinging direction is interposed between the movable body and the base plate.

Advantage of the Invention

Since the invention is configured as described above, a user repeats a motion of inclining his/her knees to the left or right while holding the movable body in which a resistance force is generated by various means, such as tension of an elastic member, hydraulic pressure, pneumatic pressure, and frictional force, between his/her two legs, thereby efficiently strengthening, particularly, core muscles of a body, such as external abdominal oblique muscles, internal abdominal oblique muscles, transverse abdominal muscles, and muscles around a lumbar as well as upper, middle and lower parts of rectus muscles of an abdomen.

Further, since the invention is suitable for strengthening external abdominal oblique muscles, internal abdominal oblique muscles, and transverse abdominal muscles, it exhibits an excellent effect of forming a curve around an abdominal part.

Further, unlike the motion of making a person's upper body stand or lie down, which is conventionally seen, it is possible to strengthen abdominal muscles with a motion that lays little burden on a waist, a pleasant posture of supine and easy motion.

Further, since even patients or old people can take exercise even in a supine posture or a seating posture, training can be performed easily, continuously and safely at homes or offices, a doctor, a nurse, a trainer, or a family member is not required to attend. As a result, it is also easy to take training intervals.

Further, even in case where a user falls asleep or is in an inappropriate seating state while using the training machine, an accident, such as falling, does not occur.

Further, since a simple structure is provided, it is possible to provide an inexpensive training machine that is suitable for transportation or accommodation.

DESCRIPTION OF REFERENCE NUMERALS AND SIGNS

1 movable body
2 base plate
3 self-weight pressing plate
X elastic member
Y cylindrical rotating rod
C hinge
K rotating body
P locking pin
B fixing band
M user

BEST MODE FOR CARRYING OUT THE INVENTION

Embodiments of the invention will be described with reference to the accompanying drawings.

FIGS. 1 to 12 show embodiments of the invention.

Figure 1:
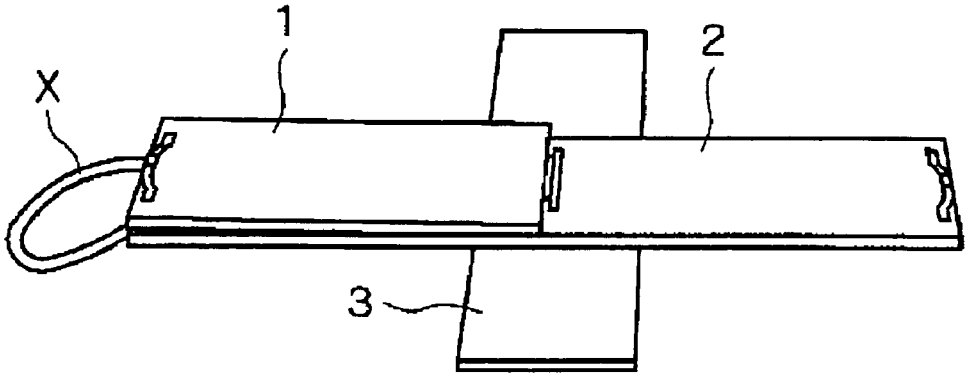
FIG. 1 is a perspective view showing one embodiment of the invention.
Figure 2:
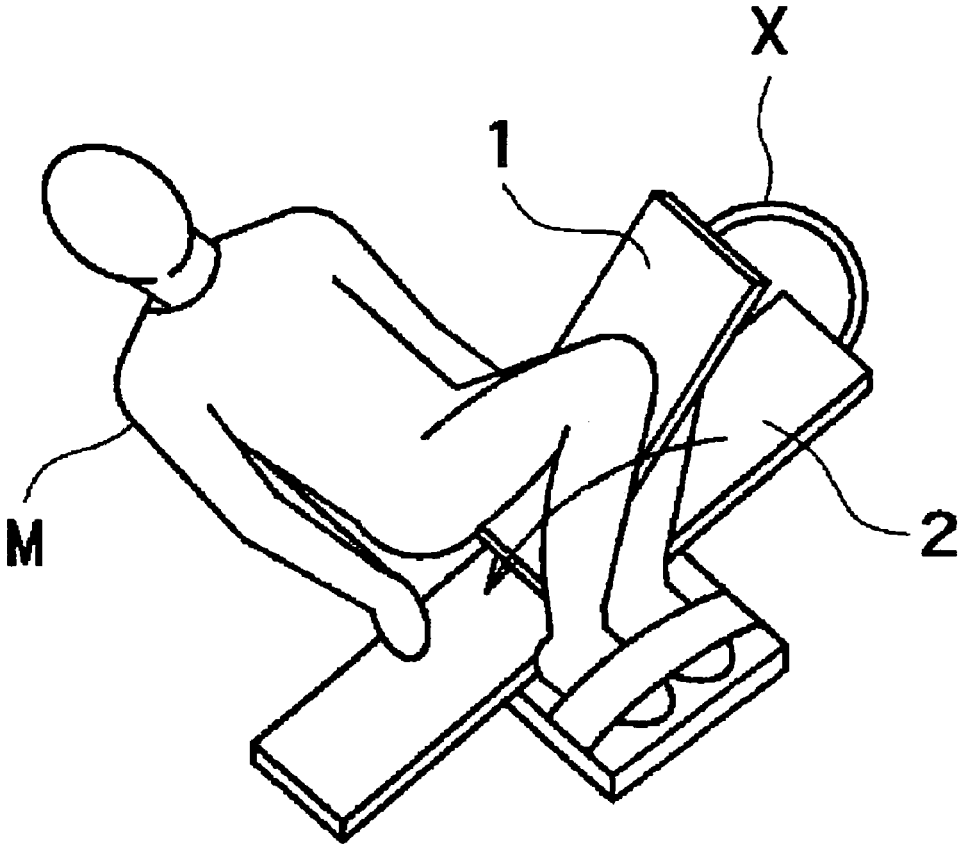
FIG. 2 is a perspective view showing one embodiment of the invention.

FIGS. 1 and 2 show one embodiment of the invention, and particularly show a training machine. FIGS. 3 to 8 show one embodiment of the invention, and particularly show a training machine. FIGS. 9 to 12 illustrate show how to use the invention.

The machine for training various kinds of abdominal and lumbar muscles according to the invention is not limited to the embodiments shown in the drawings, and it can be appropriately changed in design according to a user's physique, sex, age, muscular strength, and condition in a range to achieve the object of the invention.

Hereinafter, first, an embodiment of a movable body, a base plate, and a self-weight pressing plate will be described in detail.

The movable body 1 may be composed of, for example, a frame including a flat plate-shaped body as shown, and the width and height of the movable body is not limited as long as a user can take a swing motion right and left by holding the movable body between his/her two legs.

Although not shown, in order to achieve a pleasant exercise, it is preferable that the movable body be covered with a flexible material over the entirety thereof or a portion thereof that abuts on user's two legs.

The movable body 1 is attached so as to be swingable about each fulcrum between itself and the base plate, and is journalled so as to be swingable with respect to the base plate 2 by various known methods, including a resistant cylindrical rotating rod Y by, for example, a hinge C as shown, a spring, hydraulic pressure, or the like.

The base plate 2 is a base to which the movable body 1 is journalled, and the base plate 2 may, similar to the movable plate 1, be composed of a flat plate on a frame as shown, but it is not particularly limited.

Figure 7:
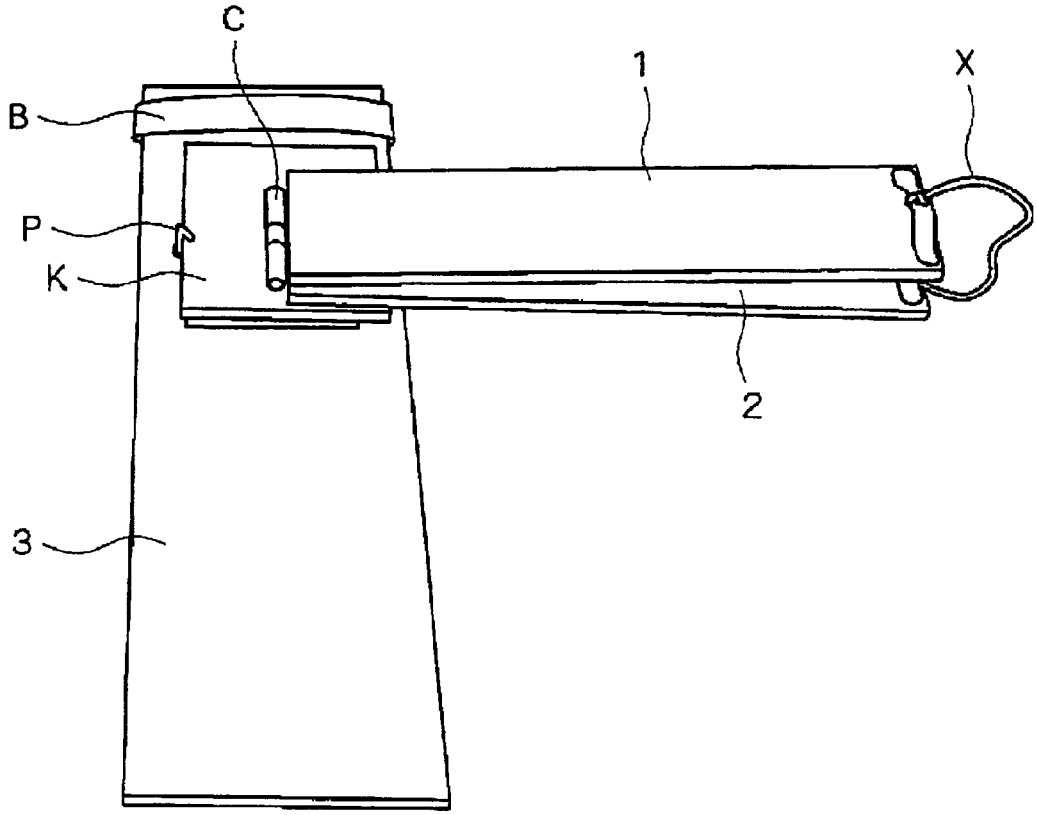
FIG. 7 is a plan view showing one embodiment of the invention.
Figure 8:
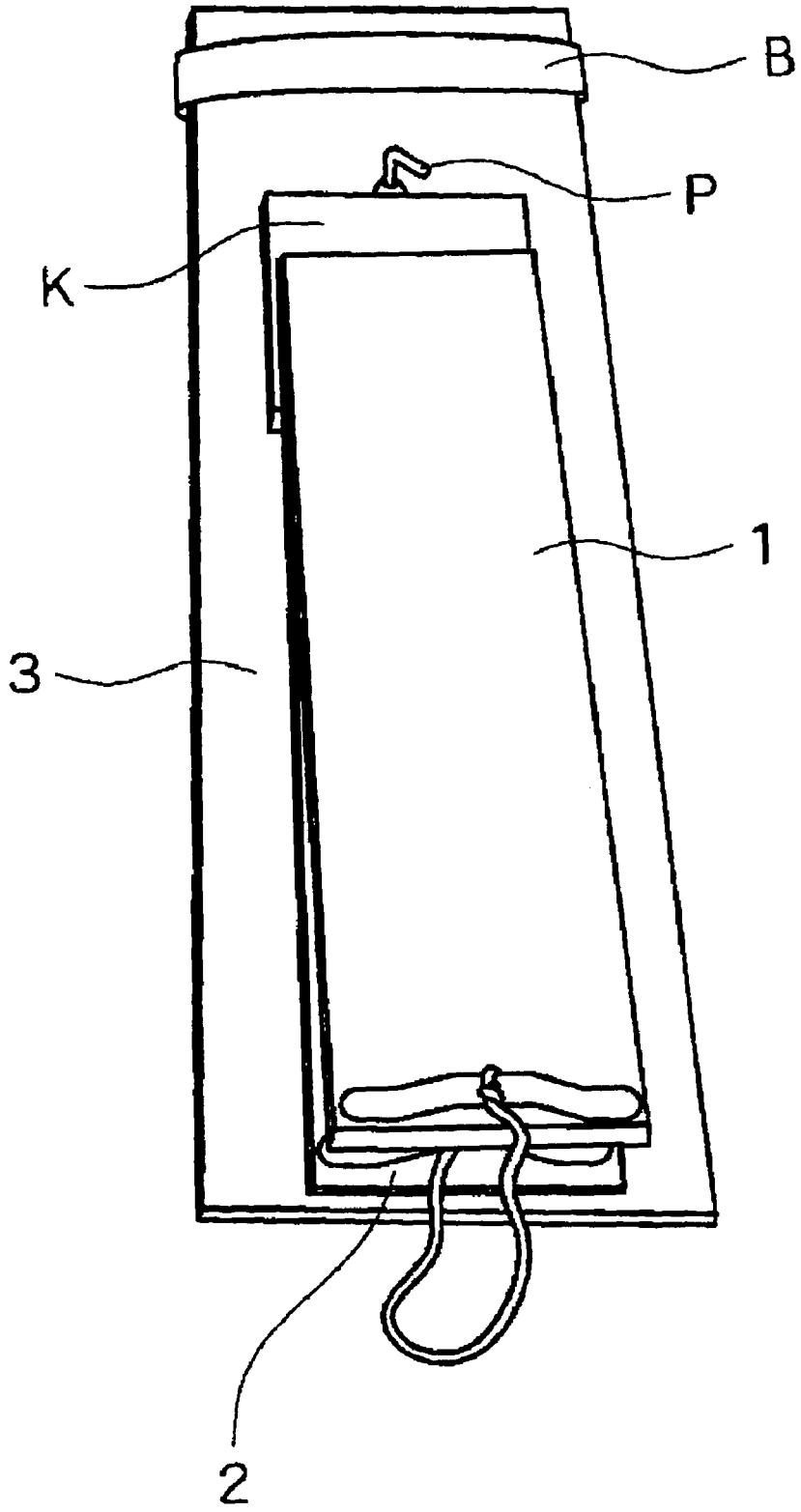
FIG. 8 is a perspective view showing one embodiment of the invention.

Further, as shown in FIGS. 7 to 8, an embodiment in which the base plate 2 has a circular configuration and it is pivotable with respect to the self-weight pressing plate can also be envisaged.

The self-weight pressing plate 3 mounts user's back and waist in a supine posture, and mounts a user's renal part in a sit-down posture, in a state where a user holds the movable body 1 between his/her two legs, and suppresses floating-up or the like in using the training machine by using the user's own weight, thereby enabling the training machine to be used stably.

In the training machine shown as one embodiment in FIGS. 1 and 2, an example of the self-weight pressing plate 3 includes a configuration in which the self-weight pressing plate 3 protrudes so as to be orthogonal to the base plate 2 from one side part of the base plate 2 in the vicinity of a place where the movable body 1 is journalled to the base plate 2. Further, the self-weight pressing plate 3 may be provided at one side part or both side parts of the base plate 2. The illustrated embodiment takes a form in which the self-weight pressing plate 3 is provided at both side parts.

Figure 3:
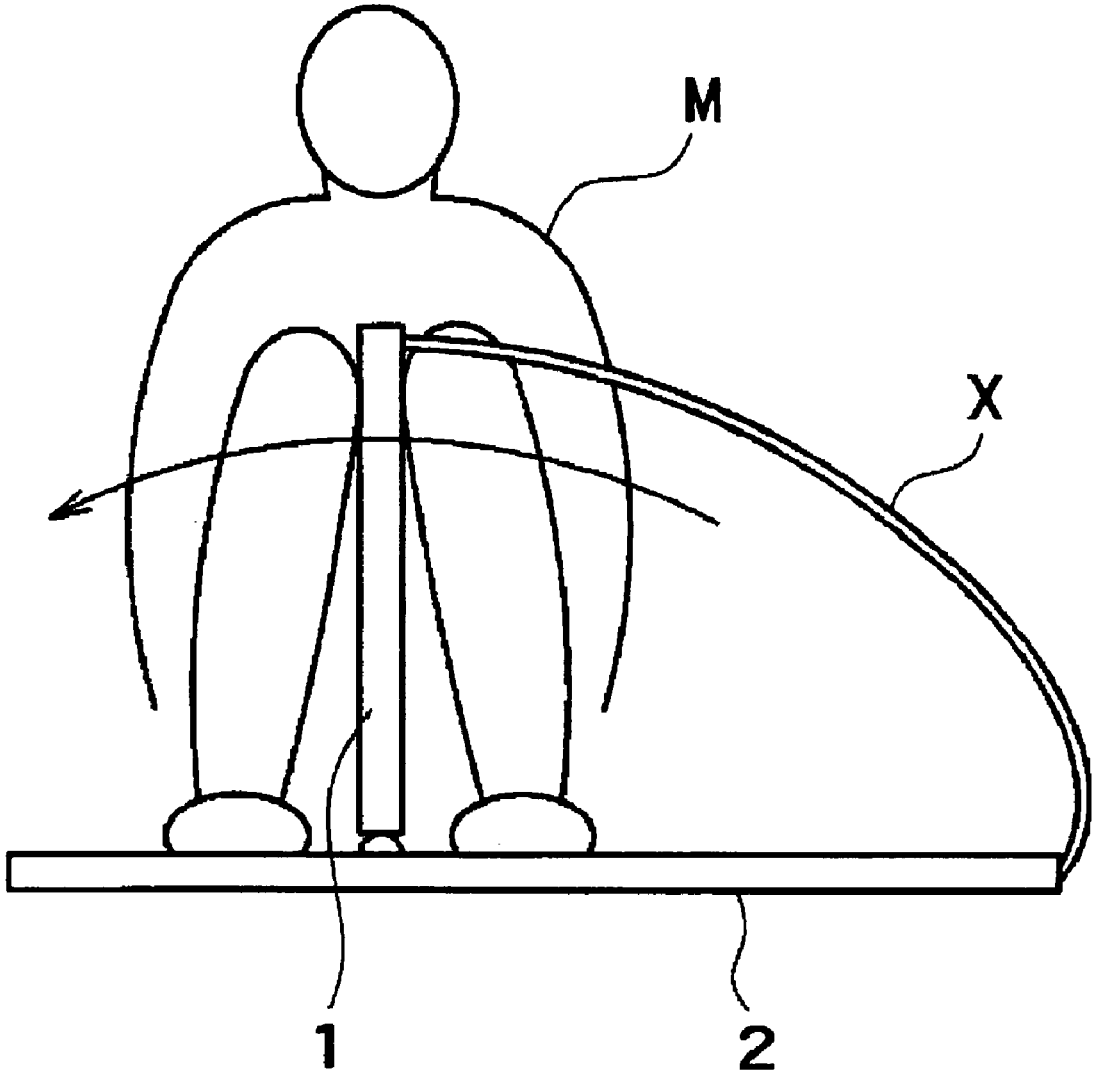
FIG. 3 is a perspective view showing one embodiment of the invention.

In the training machine shown as one embodiment in FIGS. 3 and 8, the base plate 2 to which the movable body 1 is journalled becomes pivotable with respect to the self-weight pressing plate 3.

Figure 4:
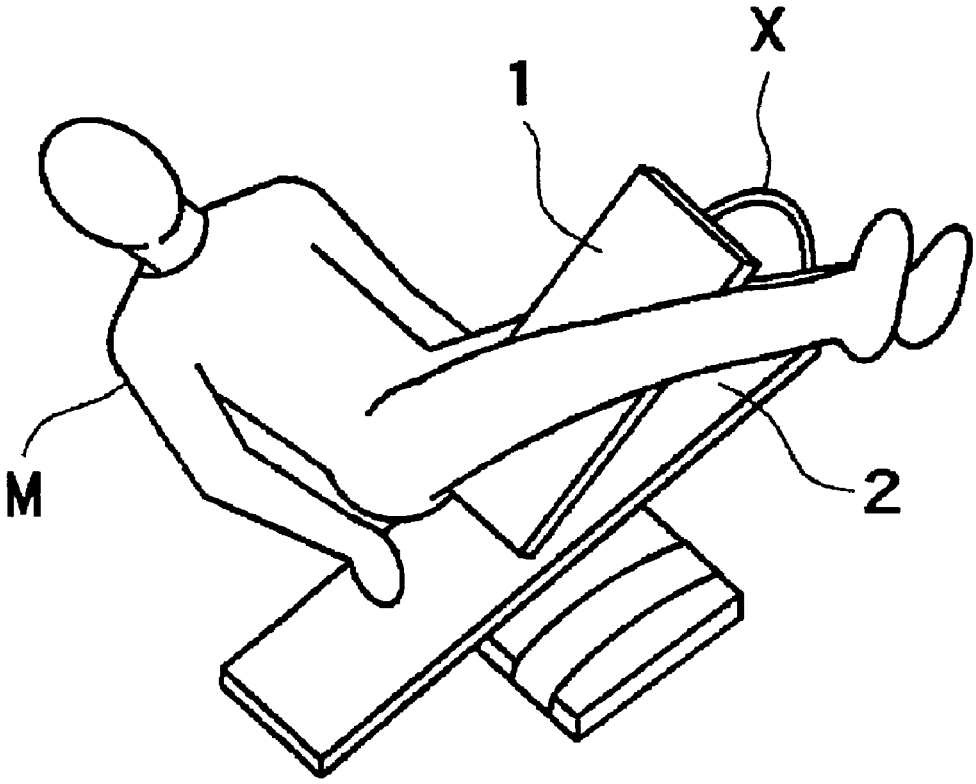
FIG. 4 is a perspective view showing one embodiment of the invention.
Figure 5:
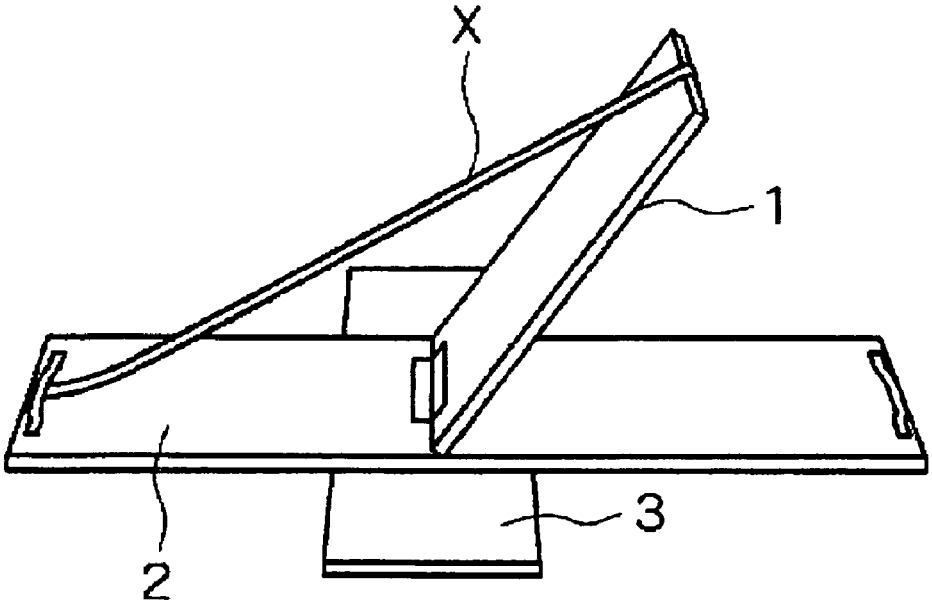
FIG. 5 is a perspective view showing one embodiment of the invention.

Also, the base plate 2 is locked by means of, for example, a locking pin P or the like, in a state where the base plate is orthogonal to the seat plate 3 to the right and left as shown in FIGS. 3 to 4, and in a state where the base plate is parallel to the self-weight pressing plate 3 as shown in FIG. 5, so that convenience of training or convenience of carrying or accommodation can be improved.

Means for pivoting the base plate 2 is not limited because the pivoting is performed using proper known methods. For example, however, in the embodiment of FIGS. 3 to 5, a rotating disc is buried in the self-weight pressing plate 3, a rotating body K coupled with the rotating disc is provided, and the rotating body K is secured to the bottom surface of the base plate 2, and in the embodiment of FIGS. 6 and 7, the base plate 2 to which the movable body 1 is journalled is formed into a circular shape, the base plate 2 is fitted in the self-weight pressing plate 3, and the base plate 2 itself is pivoted with respect to the self-weight pressing plate 3.

In addition, in the training machine, since a user rotates the base plate 2 to the right and left or freely locks it, according to an exercise while the user sits on the self-weight pressing plate 3, it is possible to obtain a highly practicable training machine, for example, by providing an extension of the self-weight pressing plate 3 with a band B that fixes ankles, etc.

In the self-weight pressing plate 3, for example, disposing a flexible material of an excellent cushioning property in a place where user's dorsal part, lumbar part, or renal part is mounted enables a user to take a pleasant exercise.

Next, an embodiment of means that loads a resistance force will be described.

The means that is interposed between the movable body 1 and the base plate 2 to load a resistance force in the machine for training various kinds of abdominal and lumbar muscles is not particularly limited, and includes various known means using an elastic member, hydraulic pressure, pneumatic pressure, or friction.

Here, the elastic member X includes a stretchable strip member, such as rubber, a spring, and the like, and an arbitrary member can be appropriately selected as long as it generates a resistance force when the movable body 1 swings.

The place where the elastic member X is disposed can be appropriately designed, including a place between a tip part of the movable body 1 and a tip part of the base plate 2, like the embodiment as shown in FIGS. 1 to 5. For example, it is also possible to adopt means that loads a resistance force by means of a coil or the like having the same function as a hinge that swingably journals the movable plate and the base plate.

Further, by making the elastic member X detachable with respect to the movable body 1 and the base plate 2, it is possible to select a load that is suitable for user's muscular strength or exercise purpose. Specifically, an athlete who tries to build up muscular strength can select rubber or a spring that generates strong resistance, while a user who exercises for rehabilitation recover after an illness can select rubber or spring that generates weak resistance.

Further, the resistance force can also be adjusted by the length of rubber.

Moreover, since the place where the elastic member X is to be disposed can be changed to the right and left by making the elastic member X detachable, even in the training machine, it is possible to change the swinging direction of the movable body 1 and the resistance thereof. As a result, a user can also take an exercise, for example, while the user sits only on the self-weight pressing plate at one side part of the base plate. (It is noted that, in the training machine, since the base plate to which the movable body is journalled is made rotatable, it is not necessary to change the swinging direction of the movable body by detachment of the elastic member). Besides, detachment of the elastic member is performed by various known methods. Specifically, the detaching method may include a method that a simple opening and closing ring that is detachable with respect to a locking metal fixture is disposed in the elastic member, in addition to a method that rubber tied to the locking metal fixture is untied.

Further, by enabling the place where the elastic member X is disposed to be changed and adjusted between the movable body 1 and the base plate 2, for example, by providing a plurality of places where the elastic member X is to be locked in the movable body 1 and the base plate 2, respectively, it is possible to appropriately adjust the resistance force when the movable body 1 is swung.

As described above, it can also be envisaged as one embodiment that a member using hydraulic force, pneumatic force, or friction as the means that loads a resistance force to the movable body 1 is interposed between the movable body 1 and the base plate 2.

Now, for example, the member using hydraulic force has conventionally been used as the resistance force loading means in training machines. That is, a hydraulic machine for which the efficiency of training caused by counter resistance or reciprocal resistance, safety caused by disappearance of the load when the exercise is stopped, and the like, are taken into consideration is generally adopted (for example, refer to Article Catalog issued by Nihon Medics Inc. in 2004, Pages 98).

In the invention, the member using hydraulic force is a member using known means that is adopted in a training machine that is conventionally provided. Although the member is not particularly limited, it is also conceivable to adopt a member that can load a resistance force to the swinging of the movable body in a place where the movable body is journalled to the base plate, for example, a member having the same function as a hinge that swingably journals the movable body to the base plate and in which a cylindrical rotating rod that can generate a resistance force by hydraulic pressure in a rotational direction is interposed.

By adopting such a hydraulic member as the resistance force loading means, as mentioned above, it is possible to provide a training machine for which safety caused by counter resistance, reciprocal resistance, or load stop caused by exercise stop are taken into consideration, it is also possible to provide an exercise involving such a load that self-weight can be supported without loading a particular resistance, which old people and people who suffer from lumbago can use with security.

Figure 6:
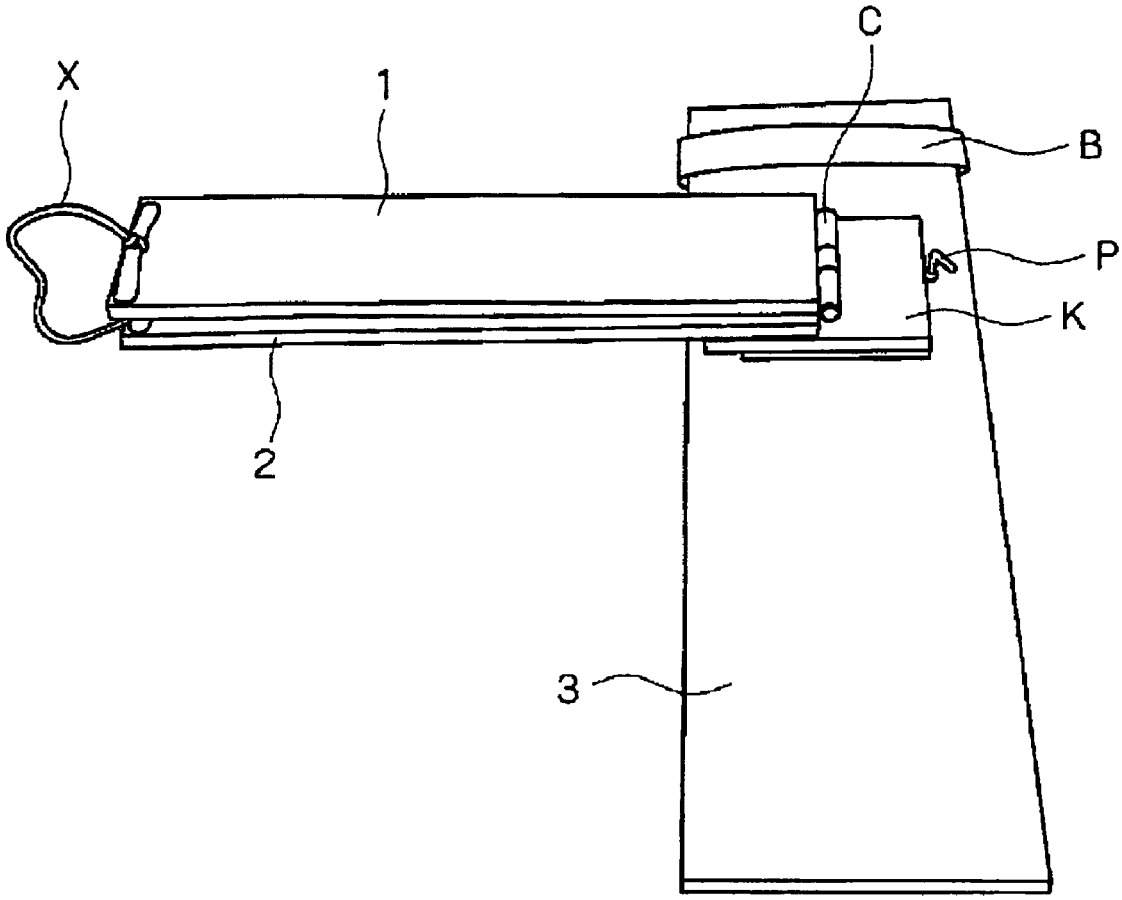
FIG. 6 is a front view showing one embodiment of the invention.

In addition, since the training machine shown in FIGS. 6 to 8 is configured such that the base and the self-weight pressing plate are integrated into one and journalled to the movable body, the means that loads a resistance force between the movable body and the base plate is not commonly used in the form in which an elastic member, such as rubber shown in FIGS. 1 to 5, is mediated. Accordingly, (although not limited to the training machine) it can be envisaged that means that loads a resistance force via a coil or the like having the same function as a hinge so that the movable body can be swingably journalled to the base plate, or that a member that can load a resistance force to the swinging of the movable body in a place where the movable body is journalled to the base plate, for example, a cylindrical rotating rod Y that has the same function as a hinge that swingably journals the movable body to the base plate and can generate a resistance force by spring or hydraulic pressure in a rotational direction of the movable body is interposed.

How to use the embodiments in the invention configured described above will now be described below.

Figure 9:
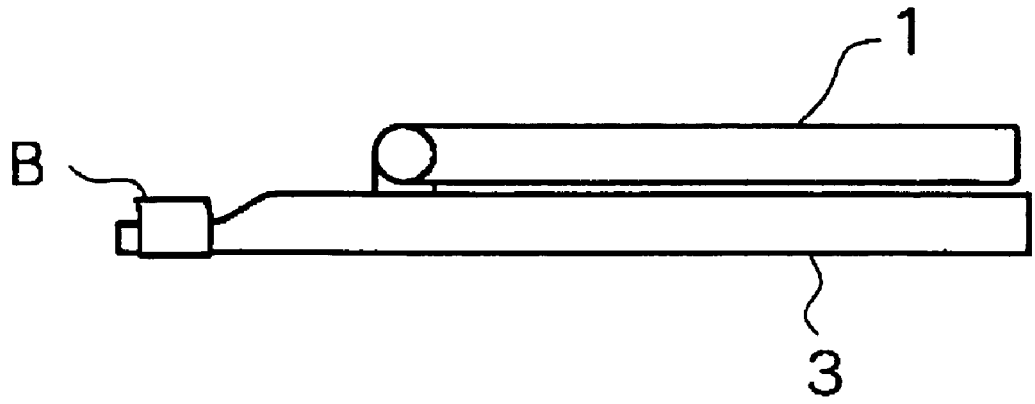
FIG. 9 is a view illustrating a usage state of the invention.

First, a user M lies supine on the self-weight pressing plate 3 in a state where his/her back or waist rests on the self-weight pressing plate, or he/she sits down in a state where his/her renal part rests on the self-weight pressing plate, such that the user holds the movable body 1 between his/her two legs from side with respect to the swinging direction of the movable body 1 (FIG. 9).

Figure 12:
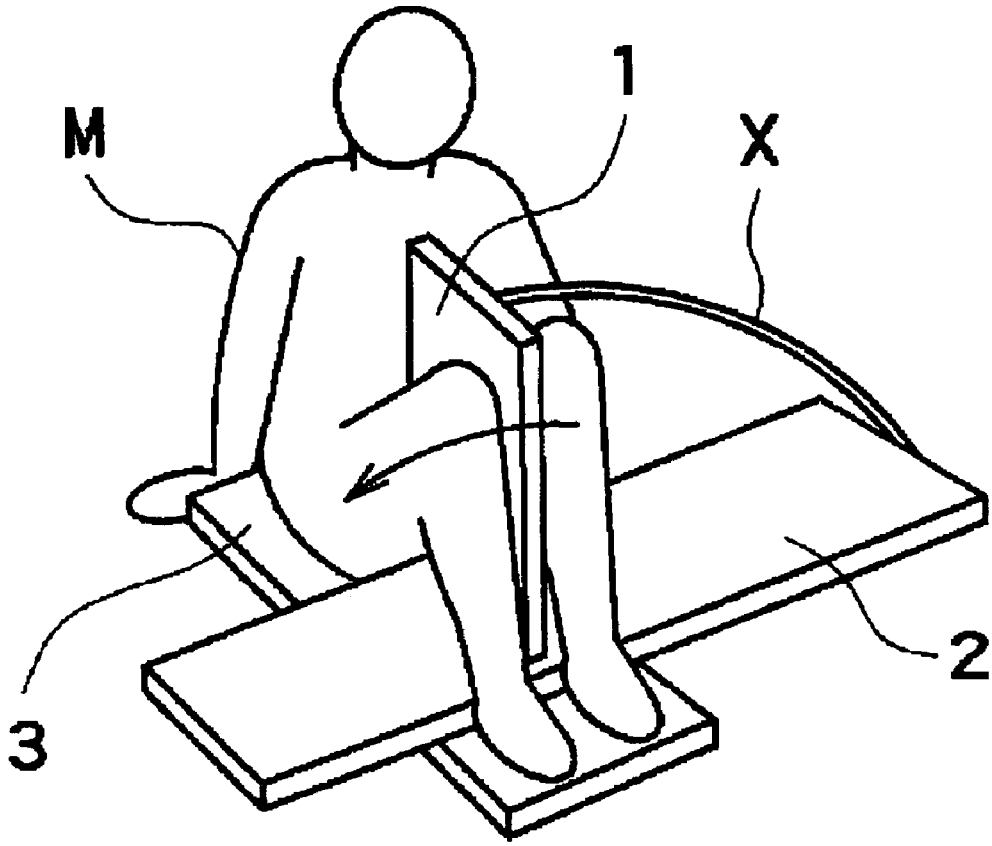
FIG. 12 is a view illustrating a usage state of the invention.

Specifically, the user M may take a posture in which an upper body is erect, including a posture in which the user' upper body is supine, or takes a posture in which knees of the user's two legs holding the movable body 1 are bent or extended (See FIG. 12). The user will appropriately select these postures according to the purpose of exercise. In this way, by providing the training machine according to the invention, the user can take a pleasant exercise in a posture in which the user's body is comfortably at rest in a supine state with his/her knees bent.

Figure 10:
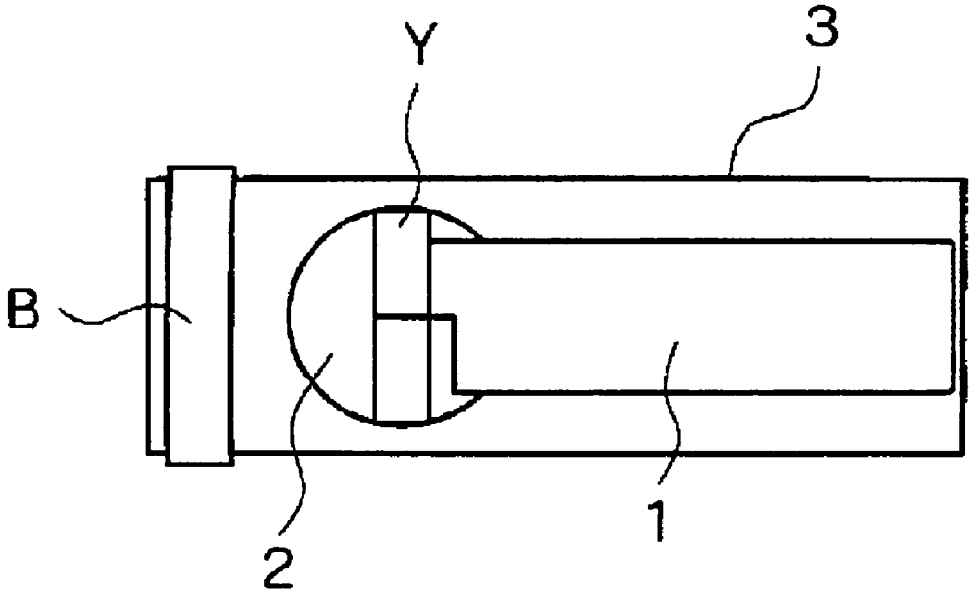
FIG. 10 is a view illustrating a usage state of the invention.
Figure 11:
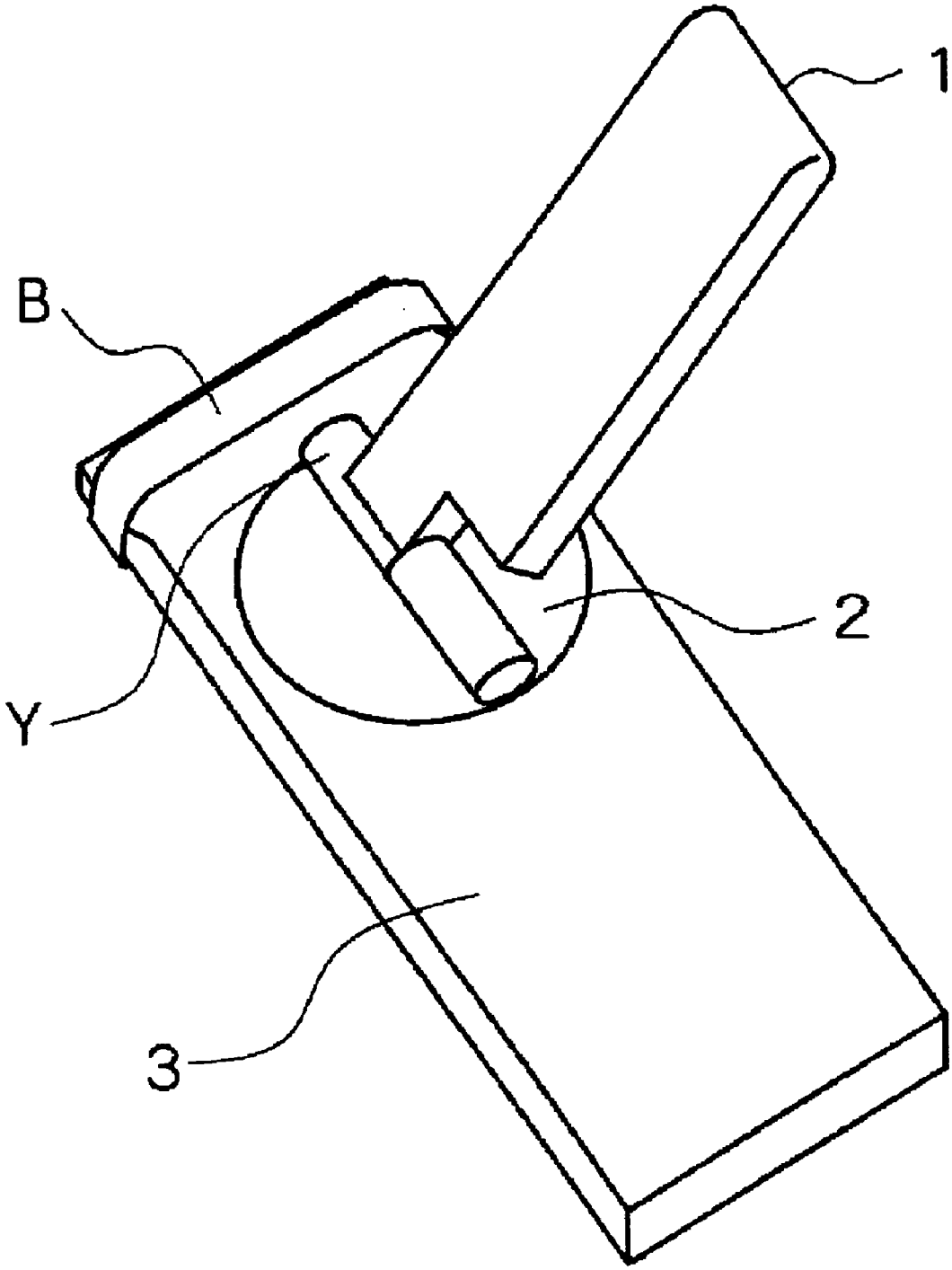
FIG. 11 is a view illustrating a usage state of the invention.

Next, the user takes a motion of swaying his/her legs in the swinging direction of the movable body, that is, to the right and left of the user, with the movable body 1 held between the user's two legs (see circular-arc-shaped arrow in FIGS. 9 to 11).

Since a member using, for example, the elastic member X or hydraulic pressure, is interposed between the movable body 1 and the base plate 2, the user M can repeatedly take a motion of swaying his/her legs to the right and left against the tension of the elastic member X, or the like.

This motion causes a load to be applied to all the abdominal muscles, and especially a twisting motion of both legs causes a load to be very efficiently applied to external abdominal oblique muscles, internal abdominal oblique muscles, and transverse abdominal muscles. As a result, since the motion is suitable for formation of a curve around a waist (so-called waistline), it is possible to practice an exercise having a high shape-up effect, and it is possible to strengthen core muscles of a body around an abdominal part or a lumbar part.

Further, when a user inclines his/her knees to the left or right while bending his/her knees in a supine position, user's lumbar is naturally turned. This turning motion makes it possible to strengthen muscles around the lumbar as well.

The invention claimed is:

1. A machine for training abdominal and lumbar muscles, said machine comprising a base plate, a flat movable body to be held between a user's knees, said movable body being swingably mounted about a fixed pivot point on an upper surface of said base plate, said movable body being movable towards and away from said upper surface of said base plate on opposite sides of said fixed pivot point, said movable body being movable in opposite directions beyond a plane extending normal to the base plate and normal to a longitudinal axis of the base plate, a self-weight pressing plate, the base plate being rotatably mounted on a center of said self-weight pressing plate with respect to a lateral axis of said self-weight pressing plate, the user lying supine or sitting on the self-weight pressing plate, and means for loading a resistance force to the movable body in a swinging direction, said means being interposed between the movable body and the base plate for turning a user's lumbar while inclining the user's knees to the left or right with the user holding the movable body between the user's knees so that when a user lies supine or sits on the self-weight pressing plate in a state where his/her knees are bent and his/her soles are grounded on the self-weight pressing plate, the movable body is at a position where the knees hold the movable body therebetween.

2. A machine for training abdominal and lumbar muscles, said machine comprising a base plate, a flat movable body to be held between a user's knees, said movable body being swingably mounted about a fixed pivot point on an upper surface of said base plate via a cylindrical rotating rod, and a hydraulic cylinder for generating a resistance force being provided inside the cylindrical rotating rod, a self-weight pressing plate on which a user lies supine or sits, the base plate being rotatably mounted on a center of the self-weight pressing plate with respect to a lateral axis of the self-weight pressing plate, and means for loading the resistance force to the movable body in a swinging direction being interposed between the movable body and the base plate for turning a user's lumbar while inclining the user's knees to the left or right and while holding the movable body, in which said resistance force is generated, between the user's knees so that when a user lies supine or sits on the self-weight pressing plate in a state where his/her knees are bent and his/her soles are grounded on the self-weight pressing plate, the movable body is at a position where the knees hold the movable body therebetween.

3. The machine for training abdominal and lumbar muscles according to claim 1, wherein a locking pin secures the base plate to the pressing plate.

* * * * *